US006186590B1

(12) United States Patent
Tseng

(10) Patent No.: US 6,186,590 B1
(45) Date of Patent: Feb. 13, 2001

(54) FOLDABLE COMBINED BENCH AND TABLE

(75) Inventor: Chuen-Jong Tseng, Chiayi Hsien (TW)

(73) Assignee: Shin Yeh Enterprse Co., Ltd., Chiayi Hsien (TW)

( * ) Notice: Under 35 U.S.C. 154(b), the term of this patent shall be extended for 0 days.

(21) Appl. No.: 09/399,888

(22) Filed: Sep. 21, 1999

(51) Int. Cl.[7] ..... A47B 3/00

(52) U.S. Cl. ..... 297/158.4; 297/158.3; 297/158.5; 297/108; 297/169

(58) Field of Search ..... 297/158.4, 158.5, 297/158.3, 159.1; 108/169, 170, 175, 174

(56) References Cited

U.S. PATENT DOCUMENTS

| | | | | |
|---|---|---|---|---|
| 1,272,187 | * | 7/1918 | Basford | 297/158.4 |
| 2,805,708 | * | 9/1957 | Bohn | 297/158.5 |
| 2,849,053 | * | 8/1958 | Beller et al. | 297/158.4 |
| 2,939,516 | * | 6/1960 | Drew | 297/158.4 |
| 4,047,754 | * | 9/1977 | Cathey | 297/158.3 |
| 4,330,151 | * | 5/1982 | Healey | 297/158.3 |
| 4,415,199 | * | 11/1983 | Wright | 297/158.4 |
| 5,314,231 | * | 5/1994 | Otterbacher | 297/158.4 |
| 5,921,623 | * | 7/1999 | Nye et al. | 297/158.4 |

FOREIGN PATENT DOCUMENTS

| | | | | |
|---|---|---|---|---|
| 205-766 | * | 3/1993 | (CA) | 297/158.4 |
| 344190 | * | 3/1960 | (CH) | 297/158.3 |

* cited by examiner

*Primary Examiner*—Laurie K. Cranmer
(74) *Attorney, Agent, or Firm*—Ladas & Parry

(57) ABSTRACT

A foldable combined bench and table includes two spaced support frames each with a bottom rod for lying on a ground surface, and frontmost and rearmost posts for detachably mounting two bench seat members, and a leg member between the posts. A mounting frame is provided with a flat board member, and includes two spaced side rails, and rightmost and leftmost crossbars which interconnect the side rails to define a first axis and which are coupled with the leg members such that the leg members are pivoted about the first axis. Two linkage assemblies are mounted between the mounting frame and the support frames. Each linkage assembly includes upper and lower linking arms which are hinged to each other about a second axis parallel to the first axis, and which are respectively secured to the mounting frame and the corresponding leg member. When the upper linking arm is swung about the second axis to a stretched position to align the upper and lower linking arms with each other, the support frames will be placed in an erected and unfolded position so as to put up the mounting frame, and when the upper linking arm is turned to a folded position, where the upper and lower linking arms are out of alignment, the bottom rods of the support frames will be brought closer to the mounting frame.

3 Claims, 5 Drawing Sheets

FOLDABLE COMBINED BENCH AND TABLE

BACKGROUND OF THE INVENTION

1. Field of the Invention

This invention relates to a combined bench and table, more particularly to a foldable combined bench and table with support frames which are foldable relative to a mounting frame.

2. Description of the Related Art

A conventional combined bench and table includes a table plate, a pair of bench plates, and a support frame to support and secure the table and bench plates. Since these components are not detachable and foldable, the conventional combined bench and table is inconvenient to carry and store.

SUMMARY OF THE INVENTION

The object of the present invention is to provide a foldable combined bench and table which is foldable so as to be stored and transported conveniently.

According to this invention, the foldable combined bench and table includes a pair of support frames. Each support frame includes a bottom rod adapted to be laid on a ground surface and spaced apart from the bottom rod of the other support frame in a longitudinal direction. The bottom rod extends in a transverse direction relative to the longitudinal direction, and has front and rear ends which extend uprightly to form frontmost and rearmost posts for detachably mounting a pair of bench seat members, and an intermediate portion which has a leg member that extends uprightly and that includes first proximate and distal end portions.

A mounting frame is used to mount a flat board member. The mounting frame includes a pair of side rails which are disposed in parallel and which are spaced apart from each other in the transverse direction, rightmost and leftmost crossbars which respectively interconnect right and left end portions of the side rails to define a first axis and which are coupled with the first distal end portions of the leg members such that the first distal end portions are pivoted about the first axis, and right and left crossbars which interconnect middle portions of the side rails.

The support frames is foldable relative to the mounting frame by a pair of linkage assemblies. Each linkage assembly includes upper and lower linking arms which respectively have second proximate and distal ends and third proximate and distal ends. The second distal end of the upper linking arm is hinged to the third proximate end of the lower linking arm about a second axis which is parallel to the first axis. In addition, the second proximate end of the upper linking arm and the third distal end of the lower linking arm are respectively secured to the right or left crossbar, and the first proximate end portion of the corresponding leg member. As such, when the second distal end of the upper linking arm is swung about the second axis to a stretched position, where the upper and lower linking arms are substantially aligned with each other, the corresponding support frame will be placed in an erected and unfolded position so as to put up the mounting frame, and when the second distal end is turned about the second axis to a folded position, where the upper and lower linking arms are out of alignment, the bottom rod of the corresponding support frame will be brought closer to the mounting frame.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
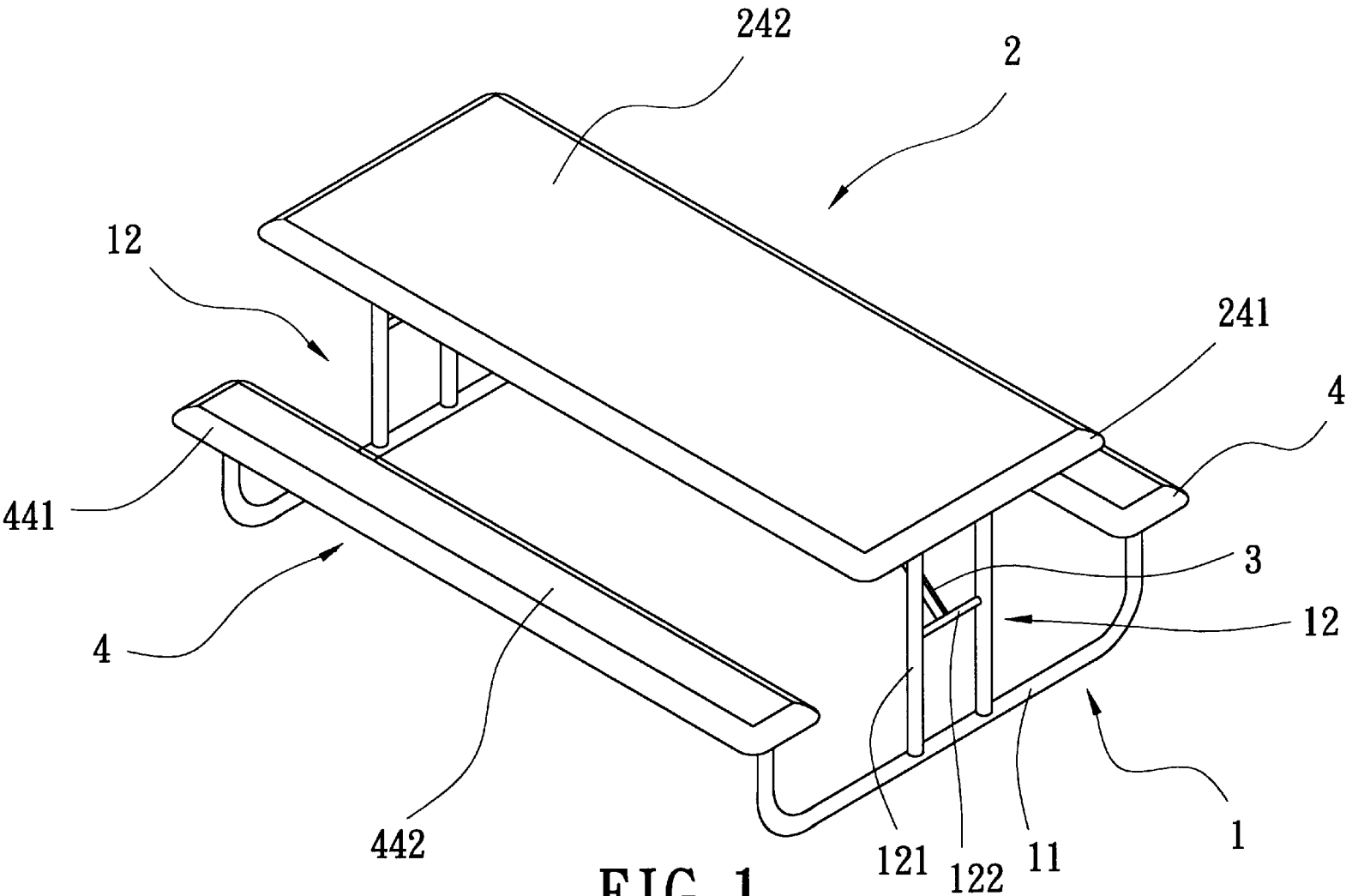
FIG. 1 is a perspective view of a preferred embodiment of a foldable combined bench and table according to this invention.
Figure 2:
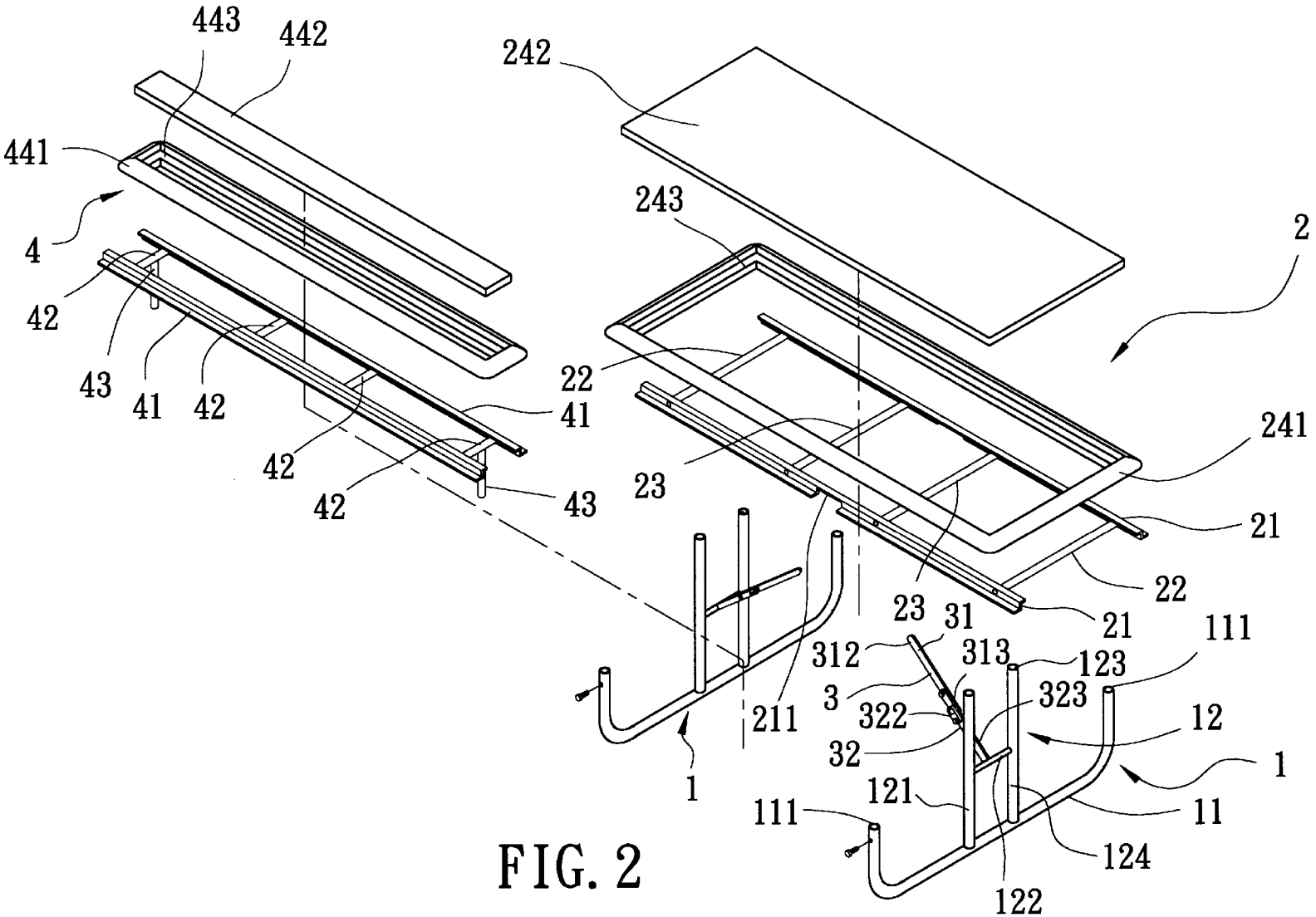
FIG. 2 is an exploded view of the preferred embodiment.

Referring to FIGS. 1 and 2, the preferred embodiment of the foldable combined bench and table according to the present invention is shown to comprise a pair of support frames 1, a mounting frame 2, a pair of linkage assemblies 3, and a pair of bench seat members 4. Each support frame 1 includes a bottom rod 11 which is adapted to be laid on a ground surface, and which is spaced apart from the other bottom rod 11 in a longitudinal direction. The bottom rod 11 extends in a transverse direction relative to the longitudinal direction, and has front and rear ends opposite to each other, and an intermediate portion interposed therebetween. Frontmost and rearmost posts 111 extend uprightly from the front and rear ends of the bottom rod 11, respectively. A leg member 12 includes front and rear posts 121 which extend uprightly from the intermediate portion of the bottom rod 11 and which are spaced apart from each other in the transverse direction. Each of the front and rear posts 121 includes a first proximate end portion 124 and a first distal end portion 123. A strut 122 is disposed transverse to and braces the first proximate end portions 124.

The mounting frame 2 includes a pair of side rails 21 which are disposed in parallel and which are spaced apart from each other in the transverse direction. Each side rail 21 includes right and left end portions, and a middle portion interposed therebetween. The side rails 21 further have a pair of recesses 211 which are respectively formed in the middle portions and which are aligned with each other in the transverse direction. Rightmost and leftmost crossbars 22 are respectively disposed to interconnect pivotally the right end portions and the left end portions of the side rails 21 so as to define a first axis. The first distal end portions 123 of the front and rear posts 121 are secured to the rightmost and leftmost crossbars 22 so as to be pivoted about the first axis. Right and left crossbars 23 are disposed to be spaced apart from each other in the longitudinal direction. Each of the right and left crossbars 23 interconnects the middle portions of the side rails 21. A table peripheral frame 241 is secured on the mounting frame 2, and has a peripheral shoulder portion 243 formed therein so as to receive a flat board member 242 to form a table. Alternatively, the mounting frame 2 may be formed integrally with the table peripheral frame 241 and the flat board member 242.

Figure 3:
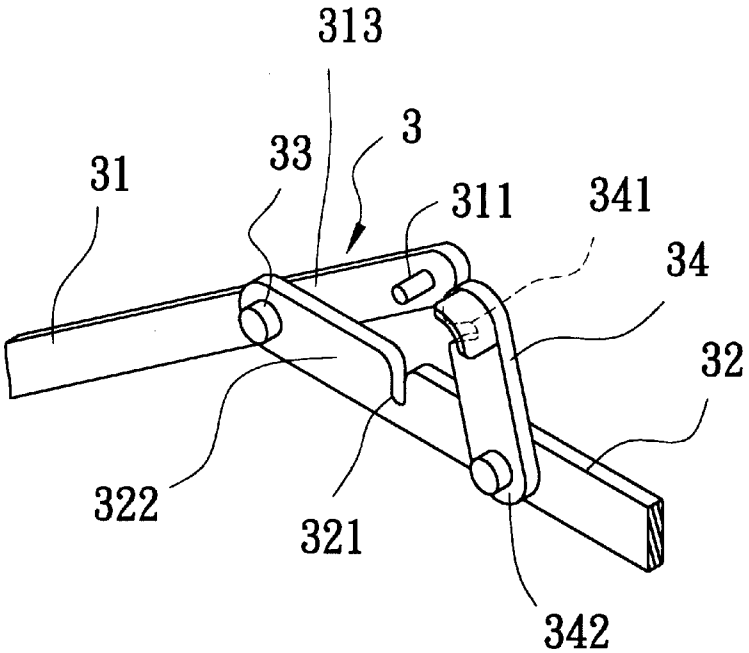
FIG. 3 is a perspective schematic view showing a linkage assembly of the preferred embodiment in a folded position.

Each linkage assembly 3 includes upper and lower linking arms 31,32 which respectively have second proximate and distal ends 312,313 and third proximate and distal ends 322,323. With reference to FIG. 3, the second distal end 313 of the upper linking arm 31 is hinged to the third proximate end 322 of the lower linking arm 32 by a pivot pin 33 about a second axis which is parallel to the first axis. The second proximate end 312 of the upper linking arm 31 and the third distal end 323 of the lower linking arm 32 are respectively secured to the right (or left) crossbar 23, and the strut 122 of the leg member 12 of a corresponding support frame 1. As such, referring to FIG. 4, when the second distal end 313 of the upper linking arm 31 is swung about the second axis to a stretched position, where the upper and lower linking arms 31,32 are substantially aligned with each other, the corresponding support frame 1 will be placed in an erected and unfolded position so as to put up the mounting frame 2. In addition, referring to FIGS. 3 and 5, when the second distal end 313 of the upper linking arm 31 is turned about the second axis to a folded position, where the upper and lower linking arms 31,32 are out of alignment, the bottom rod 11 of the corresponding support frame 1 will be brought closer to the mounting frame 2.

Figure 4:
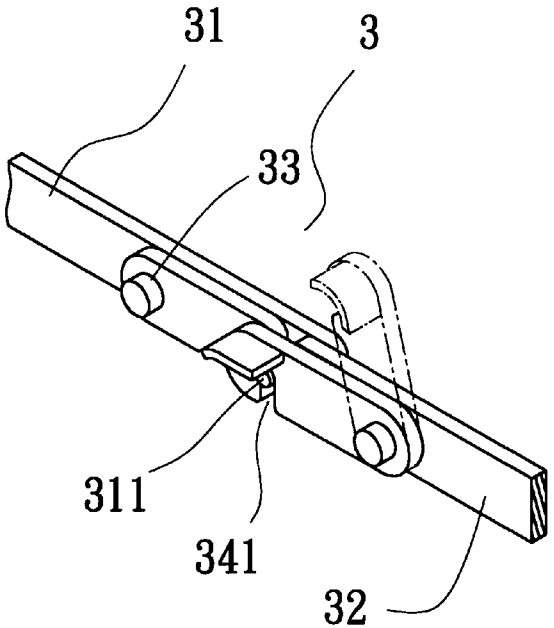
FIG. 4 is a perspective schematic view showing the linkage assembly in a stretched position.
Figure 5:
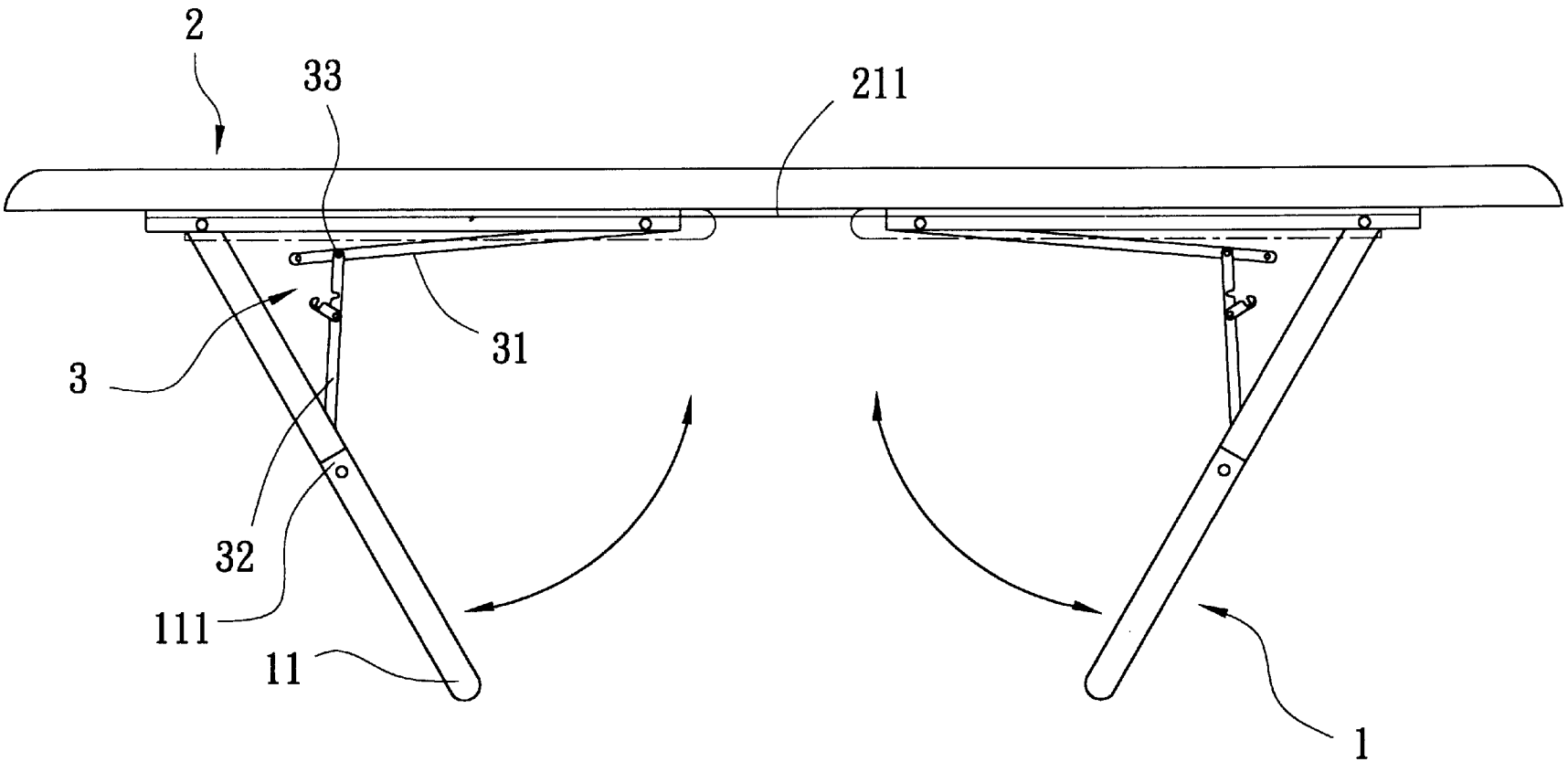
FIG. 5 is a schematic view showing how support frames of the preferred embodiment are folded.

Moreover, as shown in FIGS. 3 and 4, each linkage assembly 3 further includes a retaining member. The retaining member includes a retaining recess 321 which is formed in the third proximate end 322 of the lower linking arm 32, a retaining stem 311 which is disposed on the second distal end 313 of the upper linking arm 31 so as to be retained in the retaining recess 321 when the second distal end 313 is in the stretched position, and a retaining arm 34 which has a fourth distal end 342 that is hinged to the third proximate end 322 of the lower linking arm 32 about a third axis parallel to the second axis, and a fourth proximate end with a concavity 341 and which is swingable about the third axis to retain the retaining stem 311 in the retaining recess 321 (as shown in FIG. 4).

Each bench seat member 4 includes a bench frame which has a pair of side rails 41 that are disposed in parallel and that are spaced apart from each other in the transverse direction, a plurality of transverse rods 42 that interconnect between the side rails 41, and two connecting sleeves 43 that extend downwardly from two rightmost and leftmost ones of the transverse rods 42 so as to sleeve detachably on the respective frontmost and rearmost posts 111 of the support frames 1. A bench peripheral frame 441 is secured on the bench frame by screw fasteners (not shown), and has a peripheral shoulder portion 443 formed therein so as to receive a flat bench board 442 to form a bench.

Figure 6:
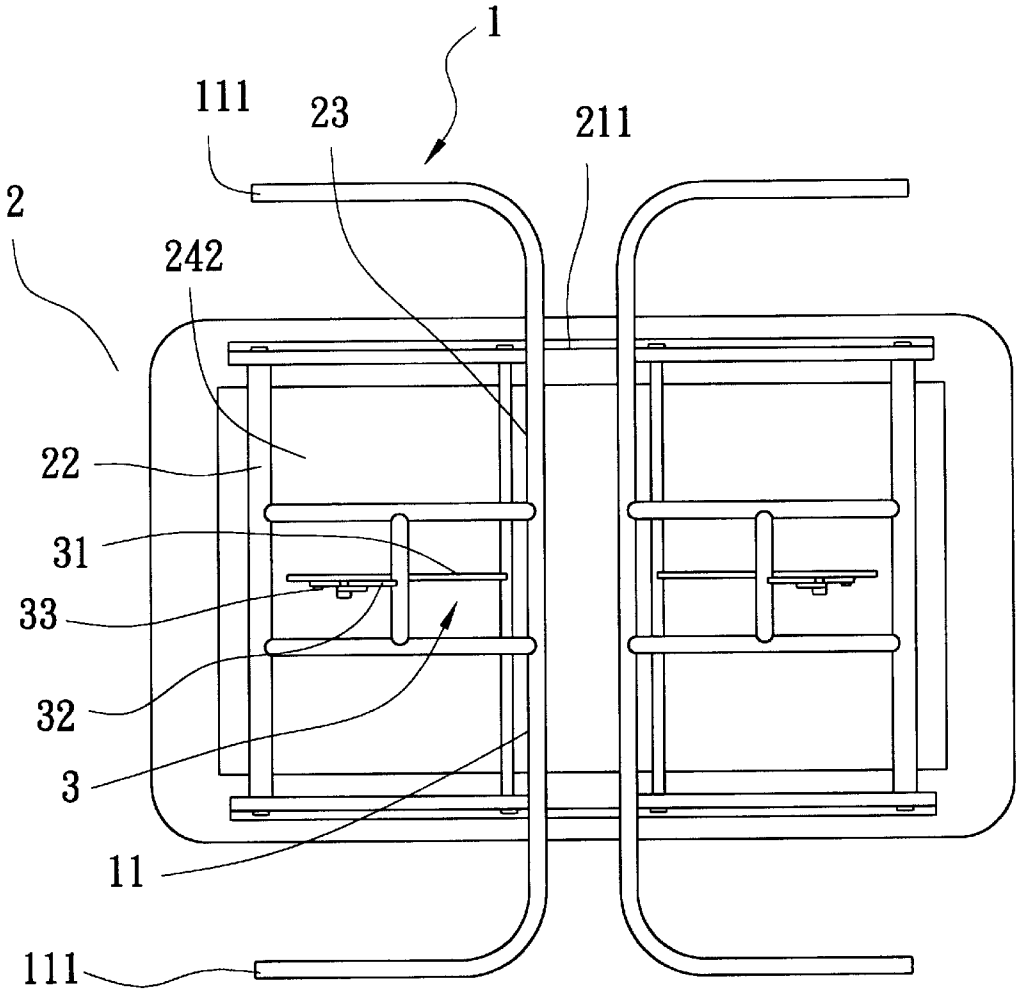
FIG. 6 is a bottom view of the preferred embodiment, showing the support frames are in a folded state.

When it is desired to fold the combined bench and table, the connecting sleeves 43 are first detached from the support frames 1. Then, referring to FIG. 3, the retaining arms 34 are swung away from the retaining stems 311 so as to permit the second distal ends 313 of the upper linking arms 31 to swing to the folded position, where the bottom rods 11 of the support frames 1 can be brought into the recesses 211 of the side rails 21, as shown in FIG. 6. Therefore, due to its foldable structure, the combined bench and table can be easily stored and conveniently transported.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A foldable combined bench and table comprising:

a. a pair of support frames, each including (i) a bottom rod adapted to be laid on a ground surface and spaced apart from said bottom rod of the other one of said support frames in a longitudinal direction, said bottom rod extending in a transverse direction relative to the longitudinal direction, and having front and rear ends opposite to each other, and an intermediate portion interposed between said front and rear ends;

(ii) frontmost and rearmost posts extending uprightly from said front and rear ends, respectively, and (iii) a leg member extending uprightly from said intermediate portion, and including a first proximate end portion and a first distal end portion;

b. a mounting frame including:

(i) a pair of side rails disposed in parallel and spaced apart from each other in the transverse direction, each of said side rails including right and left end portions, and a middle portion interposed between said right and left end portions, (ii) rightmost and leftmost crossbars respectively disposed to interconnect said right end portions and said left end portions, each of said rightmost and left most crossbars defining a first axis and being coupled with said first distal end portion of said leg member of a respective one of said support frames such that said first distal end portion is pivoted about the first axis, and (iii) right and left crossbars disposed to be spaced apart from each other in the longitudinal direction and each interconnecting said middle portions of said side rails;

c. a pair of linkage assemblies, each including upper and lower linking arms which respectively have second proximate and distal ends and third proximate and distal ends, said second distal end of said upper linking arm being hinged to said third proximate end of said lower linking arm about a second axis which is parallel to the fist axis, said second proximate end of said upper linking arm and said third distal end of said lower linking arm and said third distal end of said lower linking arm being respectively secured to a respective one of said right and left crossbars, and said first proximate end portion of said leg member of a respective one of said support frames such that when said second distal end of said upper linking arm is swung about the second axis to a stretched position, where said upper and lower linking arms are substantially aligned with each other, the respective one of said support frames will be placed in an erected and unfolded position so as to put up said mounting frame, and when said second distal end is turned about the second axis to a folded position where said upper and lower linking arms are out of alignment, said bottom rod of the respective one of said support frames will be brought closer to said mounting frame wherein each of said linkage assemblies further includes a retaining member for retaining said upper linking arm in the stretched position wherein said retaining member includes a retaining recess formed in said third proximate end of said lower linking arm, a retaining stem disposed on said second distal end of said upper linking arm so as to be retained in said retaining recess when said second distal end is in the stretched position, and a retaining arm having a fourth distal end which is hinged to said third proximate end of said lower linking arm about a third axis parallel to the second axis, and a fourth proximate end which is swingable about the third axis to retain said retaining stem in said retaining recess;

d. a pair of bench seat members, each disposed detachably across a corresponding pair of said frontmost posts and said rearmost posts; and e. a flat board member mounted on said mounting frame.

2. The foldable combined bench and table as claimed in claim 1 wherein said mounting frame has a pair of recesses respectively formed in said middle portions of said side rails and aligned with each other in the transverse direction such that said bottom rods of said support frames are received therein when said second distal ends of said upper linking arms of said linkage assemblies are in the folded position.

3. The foldable combined bench and table as claimed in claim 1 wherein each of said bench seat members includes a bench frame which has a pair of second side rails disposed in parallel and spaced apart from each other in the transverse direction, a plurality of transverse rods interconnecting between said second side rails and two connecting sleeves extending downwardly from two rightmost and leftmost ones of said transverse rods so as to sleeve on respective ones of said frontmost and rearmost posts of said support frames and a flat bench board mounted on said bench frame.

* * * * *